US007690771B2

(12) United States Patent
Okazawa

(10) Patent No.: US 7,690,771 B2
(45) Date of Patent: Apr. 6, 2010

(54) LIQUID EJECTION HEAD, LIQUID EJECTION APPARATUS, AND MANUFACTURING METHOD OF LIQUID EJECTION HEAD

(75) Inventor: Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 255 days.

(21) Appl. No.: 12/017,994

(22) Filed: Jan. 22, 2008

(65) Prior Publication Data

US 2008/0174640 A1 Jul. 24, 2008

(30) Foreign Application Priority Data

Jan. 24, 2007 (JP) ..... 2007-014075

(51) Int. Cl.
*B41J 2/045* (2006.01)
*B41J 2/14* (2006.01)

(52) U.S. Cl. ..... 347/71; 347/45

(58) Field of Classification Search ..... 347/71
See application file for complete search history.

(56) References Cited

FOREIGN PATENT DOCUMENTS

| | | |
|---|---|---|
| JP | 2001-030490 | 2/2001 |
| JP | 2007-144734 | 6/2007 |
| JP | 2007-144793 | 6/2007 |

*Primary Examiner*—Matthew Luu
*Assistant Examiner*—Lisa M Solomon
(74) *Attorney, Agent, or Firm*—Workman Nydegger

(57) ABSTRACT

A liquid ejection head includes a channel unit with a channel substrate provided with a channel section having pressure chamber cavity rows formed by arranging a plurality of pressure chamber cavities in rows. The liquid ejection head also includes a nozzle substrate provided with a plurality of nozzle orifices formed so as to correspond to the pressure chambers. A sealing plate of the liquid ejection head seals an opening of the channel section of the channel substrate, in which the nozzle substrate is joined, with one surface of the channel substrate. The sealing plate is joined with the opposite surface of the channel substrate so that the channel unit has a series of liquid channels from a common liquid chamber to the nozzle orifices. The liquid ejection head has a head case to which the channel unit is fixed.

10 Claims, 6 Drawing Sheets

LIQUID EJECTION HEAD, LIQUID EJECTION APPARATUS, AND MANUFACTURING METHOD OF LIQUID EJECTION HEAD

BACKGROUND

1. Technical Field

The present invention relates to a liquid ejection head, such as an ink-jet type recording head, a liquid ejection apparatus, and a manufacturing method of a liquid ejection head, and more particularly to a liquid ejection head which includes a channel unit provided with a series of liquid channels extending from a common liquid chamber down to nozzle orifices through pressure chambers and which can discharge liquid in the form of liquid droplets from the nozzle orifices thereof, a liquid ejection apparatus, and a manufacturing method of a liquid ejection head.

2. Related Art

As for liquid ejection heads structured to discharge out liquid droplets from nozzle orifices thereof by causing pressure fluctuation to liquid accommodated in pressure chambers, there are known, for example, ink-jet type recording heads used for image recording apparatuses, such as printers, color material ejection heads used for manufacture of color filters of liquid crystal displays, electrode material ejection heads used for electrode formation of organic electroluminescence (EL) displays and field luminescence displays (FED), and living body organic matter ejection heads used for manufacture of biochips (biotip), etc.

There are various forms of such a liquid ejection head. One exemplary form of the ink-jet type recording head (hereinafter, referred to as a recording head) in an ink-jet type recording apparatus (hereinafter, referred to as a printer) includes a channel unit fixed to a head case, the channel unit having a structure in which a nozzle substrate provided with a plurality of nozzle orifices, a channel substrate provided with a channel section such as pressure chamber cavities or grooves which define a series of ink channels from a common ink chamber down to the nozzle orifices through pressure chambers, and a resilient plate (also called a sealing plate which seals an opening of the channel substrate) which causes elastic deformation to diaphragm sections corresponding to the pressure chambers in response to the operation of a pressure generating means (for example, piezoelectric vibrator) are laminated. Of composition components of the channel unit, the channel substrate is required to be machined at a high density with high precision so as to respond to high density of a recorded image and high speed of recording operation. Accordingly, the channel substrate is suitably made of a crystalline base material such as silicon single crystal base material (silicon wafer) by which a fine shape can be formed by, for example, an anisotropic etching process with sufficient accuracy of dimension.

Accordingly, it is important to assemble the above-described composition components with high positioning accuracy in order to control the discharge operation of the recording head with high precision. Thus, JP-A-2001-30490 discloses a recording head whose composition components are laminated on and combined with each other in the state in which relative positions of all the composition components are specified in a manner such that composition components of a channel unit and a head case are provided with two through-holes which are positioning references and positioning pins are inserted in the two through-holes.

By the way, when a channel substrate is made of a crystalline base material as described above, the through-holes of this channel substrate are formed by etching like pressure chamber cavities. In this case in which there is a difference between the interval of the through-holes of the channel substrate and the interval of the through-holes of the head case, mechanical stress is applied to the channel substrate via the positioning pins due to the difference of the intervals, and thus there was the probability that the channel substrate cracks or breaks.

SUMMARY

An advantage of some aspects of the invention is that it provides a liquid ejection head, a liquid ejection apparatus, and a manufacturing method of a liquid ejection head, which are capable of positioning composition components of a head with sufficient accuracy while preventing the composition components from cracking or breaking.

According to one aspect of the invention, there is provided a liquid ejection head including a channel unit including a channel substrate provided with a channel section which includes pressure chamber cavity rows formed by arranging a plurality of pressure chamber cavities to be pressure chambers in rows, a nozzle substrate provided with a plurality of nozzle orifices formed so as to correspond to the pressure chambers, respectively, and a sealing plate which seals an opening of the channel section of the channel substrate, wherein the nozzle substrate is joined with one surface of the channel substrate and the sealing plate is joined with the opposite surface of the channel substrate so that the channel unit has a series of liquid channels from a common liquid chamber to the nozzle orifices, and a head case to which the channel unit is fixed, in which a first reference hole and a second reference hole are disposed in a frame region formed outside a channel section forming region at one side of an arrangement direction of the pressure chamber cavity rows, and a third reference hole and a fourth reference hole are formed in the frame region at the opposite side of the arrangement direction of the pressure chamber cavity rows, in which the first reference hole, the second reference hole, and the fourth reference hole have a polygonal shape whose sides are equal to each other in length, in which the third reference hole has a polygonal shape whose sides are different in length, in which dimension of shorter sides of the third reference hole is equal to dimension of the sides of the other reference holes other than the third reference hole, and in which each of the nozzle substrate and the sealing plate is provided with a first through-hole, a second through-hole, a third through-hole, and a fourth through-hole at positions corresponding to the first reference hole, the second reference hole, the third reference hole, and the fourth reference hole of the channel substrate.

According to the structure, the second reference hole and the second through-hole overlap each other and the fourth reference hole and the fourth through-hole overlap each other, and then positioning pins are inserted in the second reference hole and the second through-hole, and the fourth reference hole and the fourth through-hole, respectively. The positioning pins are removed from the holes after jointing the nozzle substrate, the channel substrate, and the sealing plate with each other by specifying the relative positions of the nozzle substrate, the channel substrate, and the sealing plate by using the second reference hole and the fourth reference hole as a positioning reference. After that, the channel unit is fixed to a channel mounting surface of the head case in the state in which a first case pin is inserted in the first reference hole and the first through-hole and a second case pin is inserted in the third reference hole and the third through-hole and thus the relative positions are specified. Thanks to such a structure, it is possible to assemble the composition components in the state in which the composition components are positioned with sufficient accuracy without applying mechanical stress to the channel substrate.

The above aspect is suitable for a structure in which the channel substrate is made of a crystalline base material. The above aspect is further suitable for a structure in which the pressure chamber cavity rows are constituted in a manner such that the pressure chamber cavities are arranged in rows in a direction of a vertical axis direction of a first crystal orientation plane which perpendicularly intersects the surface of the crystalline base material in the channel substrate.

In the liquid ejection head, it is preferable that the first reference hole, the second reference hole, and the fourth reference hole have a lozenge shape having four sides which are equal to each other in length, in which the sides of the lozenge shape are on the first crystal orientation plane perpendicularly intersecting a surface of a crystalline base material and a second crystal orientation plane obliquely intersecting the first crystal orientation plane and perpendicularly intersecting the surface of the crystalline base material.

In the liquid ejection head, it is preferable that the third reference hole is a long hole in the form of a parallelogram whose shorter sides are on a first crystal orientation plane perpendicularly intersecting a surface of a crystalline base material and whose longer sides are on a second crystal orientation plane obliquely intersecting the first crystal orientation plane and perpendicularly intersecting the surface of the crystalline base material.

According to the structure, the third reference hole is a long hole longer in a direction of the second crystal orientation plane. Accordingly, in the case in which the interval between the first reference hole and the third reference hole (hole-to-hole distance) and the interval between the case pins (pint-to-pin distance) has an offset therebetween, it is possible to compensate the offset by a gap provided between the inside surface of the long hole and the second case pin. Thanks to such a structure, it is possible to fix the channel unit to the head case in the state in which the composition components are accurately positioned with sufficient accuracy while preventing the channel substrate from cracking or breaking.

In the liquid ejection head, it is preferable that either the second through-holes or the fourth through-holes of the nozzle substrate and the sealing plate have a perfect circle shape with a diameter which is equal to a diameter of an inscribed circle of the reference holes other than the third reference hole, wherein the others of the second through-holes and the fourth through-holes have a long hole shape corresponding to an expanded form of the former through-holes expanded in a direction of a row of both the second through-holes and the fourth through-holes, and wherein inside dimension of the first through-hole and the third through-hole is set to be larger than a diameter of an inscribed circle.

According to the structure, in the case in which there is an offset between the interval between the second reference hole and the fourth reference hole in the channel substrate and the interval between the second through-hole and the fourth through-hole in the nozzle substrate, or there is an offset between the interval between the second reference hole and the fourth reference hole in the channel substrate and the interval between the second through-hole and the fourth through-hole in the sealing plate, it is possible to compensate the offset without applying mechanical stress to the channel substrate because the interval of the positioning pins is adjusted to match with the interval of the interval between the second through-hole and the fourth through-hole by the gap between the inside surface of either one of the second reference hole and the fourth reference hole, which is set as the long hole, and the second positioning pin. Accordingly, since the inside dimension of each of the first through-hole and the third through-hole in each of the nozzle substrate and the sealing plate is set to be larger than the inscribed circle of the reference holes (except for the third reference hole), it is satisfactory that the projection portion of the nozzle substrate and the sealing plate in the openings of the first reference hole and the third reference holes is small. For this reason, it is possible to facilitate insertion of the case pins. Further, it is possible to prevent the case pins from coming into contact with the projections when the case pins are inserted in the reference holes and thus to prevent the projections from missing.

In the liquid ejection head, it is preferable that a distance between centers of the first reference hole and the third reference hole is longer than a distance between centers of the second reference hole and the fourth reference hole.

According to another aspect of the invention, there is provided a liquid ejection apparatus comprising the liquid ejection head.

Thanks to such a structure, since composition components of the liquid ejection head are combined in the state in which they are positioned with sufficient accuracy, at the time of performing discharge operation by the liquid ejection head, the liquid ejection head can discharge ink droplets at a regulated rate and regulated speed from the nozzle orifices thereof. Thus, it is possible to make the liquid droplets strike the target, a discharge subject, with high precision.

It is preferable that the liquid ejection apparatus further includes a wiping mechanism which wipes a nozzle formed surface of the liquid ejection head, in which the liquid ejection head is mounted in a manner such that the second reference hole and the fourth reference hole are disposed at the lower stream side of a direction of wiping performed by the wiping mechanism with respect to the nozzle formed surface.

According to the structure, it is possible to prevent the nozzle formation surface from being contaminated at the time of wiping by the wiping mechanism. In the liquid ejection head which is assembled, inside the first reference hole, the first through-hole, the third reference hole, and the third through-hole are provided the case pins inserted therein, but the second reference hole, the second through-hole, the fourth reference hole, and the fourth through-hole remain empty. Accordingly, liquid likely enters these empty holes. For this reason, if the second reference hole (the second through-hole) and the fourth reference hole (the fourth through-hole) are arranged at the upper stream side of the direction of wiping performed by a wiping mechanism when attaching the liquid ejection head to liquid ejection apparatus, the wiper blade draws out the liquid accommodated in the openings to the nozzle formed surface at the time of wiping, and thus there is the likelihood that the nozzle formed surface may be contaminated. Therefore, it is possible to obviate such a trouble with the posture in which the second reference hole and the fourth reference hole are arranged at the lower stream side of the direction of wiping.

According to a further aspect of the invention, there is provided a manufacturing method of the liquid ejection head including (a) forming a first case pin and a second case pin so as to project from a channel mounting surface of the head case at positions corresponding to the first reference hole and the third reference hole of the channel substrate, respectively, (b) specifying relative positions of the nozzle substrate, the channel substrate, and the sealing plate on the basis of the second reference hole and the fourth reference hole by inserting positioning pins in the second reference hole and the fourth reference hole, respectively, after positioning the second reference hole and the fourth reference hole so as to overlap the second through-hole and the fourth through-hole, respectively, and (c) fixing the channel unit to a channel mounting surface of the head case in the state in which the relative positions of the channel unit and the head case are specified by way of operations of jointing the nozzle substrate, the channel substrate, and the sealing plate with each other after specifying the relative positions of the nozzle substrate, the channel substrate, and the sealing plate, removing the positioning pins from the corresponding holes, and inserting the first case pin in the first reference hole and the first through-hole and the second case pin in the third reference hole and the third through-hole.

According to the aspect, the nozzle substrate, the channel substrate, and the sealing plate are joined with each other after the relative positions thereof are specified in a manner such that the positioning pins are inserted in the corresponding holes in the state in which the second reference hole overlaps the second through-hole and the fourth reference hole overlaps the fourth through-hole. After that, the positioning pins are removed from the corresponding holes, and then the first case pin is inserted in the first reference hole and the first through-holes and the second case pin is inserted in the third reference hole and the third through-holes. Thus, the relative positions of the nozzle substrate, the channel substrate, and the sealing plate are specified. In such a state, the channel unit is fixed to the channel installation surface of the head case. Accordingly, it is possible to assemble the composition components in the state in which the relative positions of the composition components are specified with sufficient accuracy without applying mechanical stress to the channel substrate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
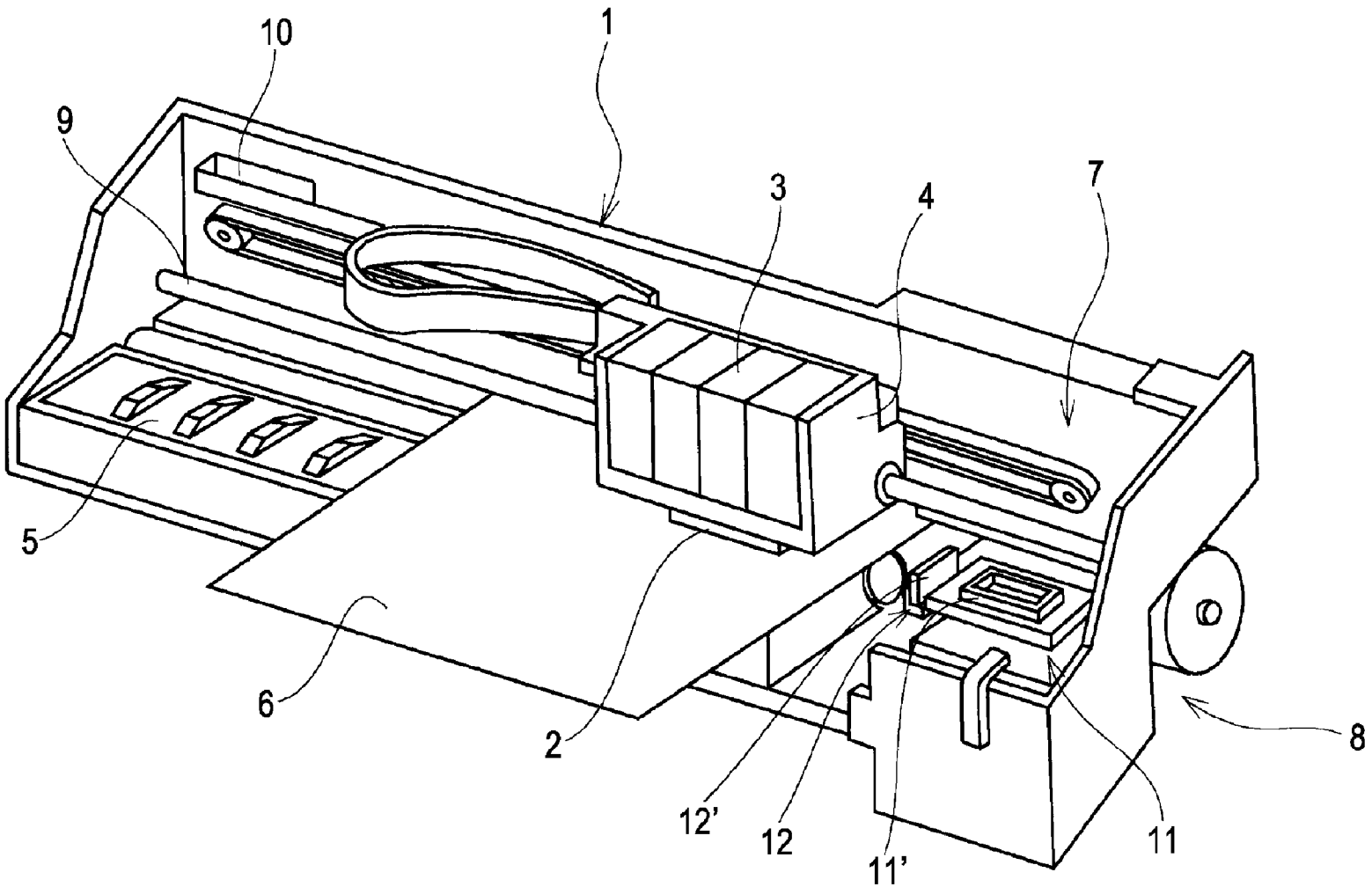
FIG. 1 is a perspective view illustrating a structure of a printer.

Hereinafter, preferred embodiments of the invention will be described with reference to the accompanying drawings. In addition, although various limitations are made as a suitable example of the invention with the form of the embodiment described below, but the scope of the invention should not be construed as being limited to the embodiments as long as there is no statement of the purport that this invention is limited in the following description. Hereinafter, an ink-jet type printer (hereinafter, referred to as a printer) shown in FIG. 1 is exemplified as a liquid ejection apparatus of the invention.

A printer 1 includes a carriage to which a recording head 2 which is a kind of a liquid ejection head is attached and to which an ink cartridge 3 is detachably attached, a Platen 5 disposed under the recording head 2, a carriage moving mechanism 7 which enables the carriage 4, on which the recording head 2 is mounted, to travel in the paper width direction of recording paper 6 (a kind of a discharge subject), and a paper feed mechanism 8 which transports the recording paper 6 in the paper feed direction which intersects perpendicularly to the paper width direction. Here, the paper width direction is the main scanning direction (the head scanning direction), and the paper feed direction is the sub-scanning direction (namely, direction which perpendicularly intersects the head scanning direction). In addition, the ink cartridge 3 may adopt a structure in which it is mounted on the carriage 4 or a structure in which it is mounted on the case side of the printer 1 and supplied to the recording head 2 through an ink supply tube.

The carriage 4 is structured in a manner such that it is pivotably attached to a guide rod 9 extending in the main scanning direction so as to travel in the main scanning direction along with the guide rod 9 by the operation of the carriage move mechanism 7. The position of the carriage 4 in the main scanning direction is detected by a linear encoder 10, and a detection signal is transmitted to a control section (not shown) as position information. Thus, the control section can control record operation (discharge operation) of the recording head 2, recognizing the scanning position of the carriage 4 (recording head 2) on the basis of the position information from the linear encoder 10.

Moreover, a home position used as the scanning starting point of the recording head 2 is set to be in the traveling range of the recording head 2 but to be outside the Platen 5. The home position is provided with a capping mechanism 11. The capping mechanism 11 seals the nozzle formed surface of the recording head 2 by a capping member 11' so as to prevent an ink solvent from evaporating from the nozzle orifice 19 (see FIG. 2). The capping mechanism 11 is used for cleaning operation which carries out suction and discharge of ink compulsorily from the nozzle orifices 19 by applying a negative pressure to the nozzle formed surface of the recording head 2 in the sealed state.

The home position is further provided with a wiping mechanism 12 for wiping of the nozzle formed surface of the recording head 2. This wiping mechanism 12 is equipped with a wiper blade 12' which is made of an elastic material, such as an elastomer, and is structured such that the wiper blade 12' moves to a position (wiping position) where the upper end of wiper blade 12' can come into contact with the nozzle formed surface of the recording head 2, when the recording head 2 passes over the wiping mechanism 12. If the recording head 2 moves in the state in which the upper end of wiper blade 12' is in contact with the nozzle formed surface of the recording head 2, the nozzle formed surface of the recording head 2 will be wiped away by the wiper blade 12' (wiping). Thus, excessive ink drops adhered to the nozzle formed surface of the recording head 2 can be removed, for example after cleaning treatment.

Figure 2:
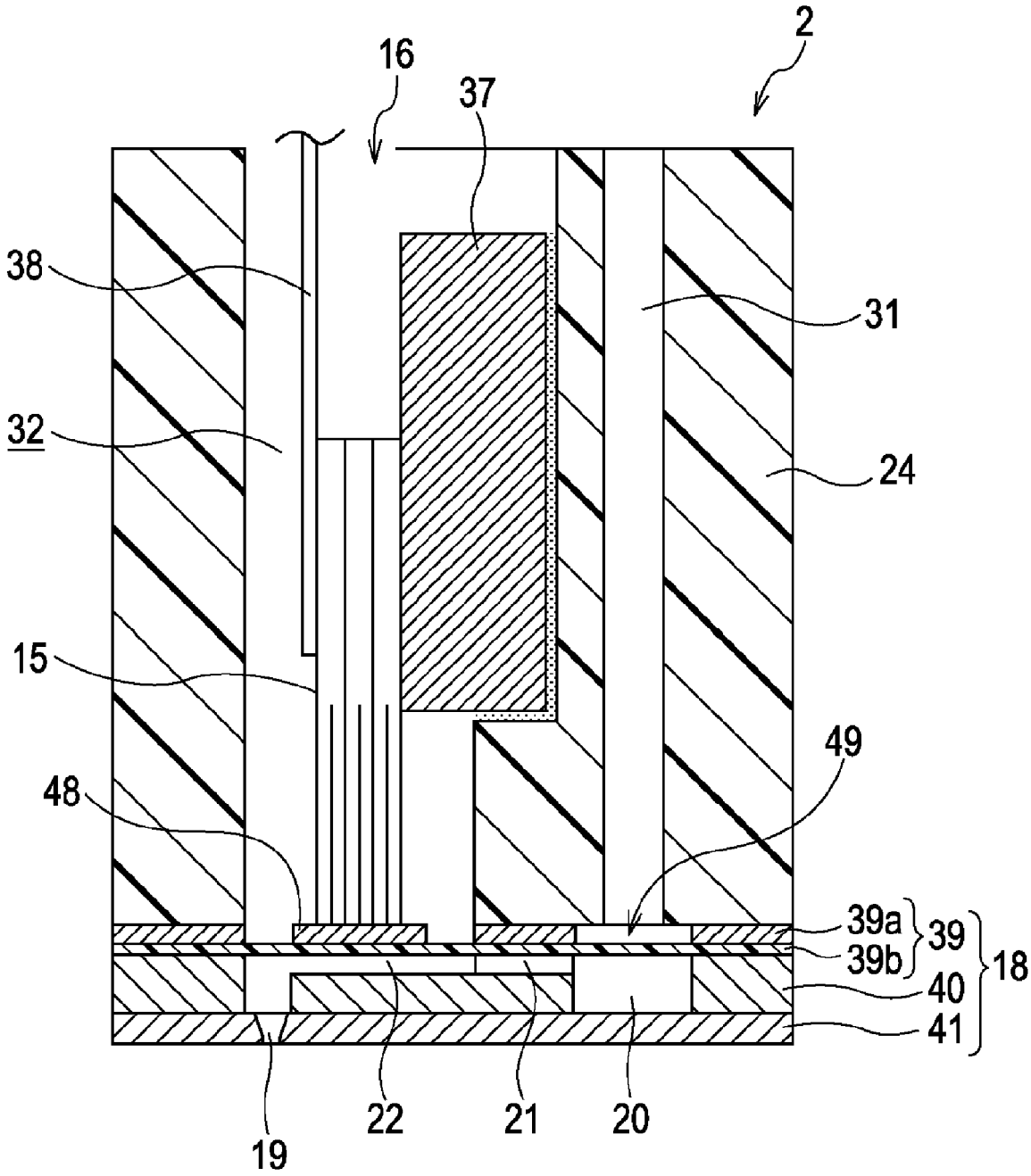
FIG. 2 is a sectional view illustrating main part of a recording head for explaining a structure of the recording head.
Figure 3:
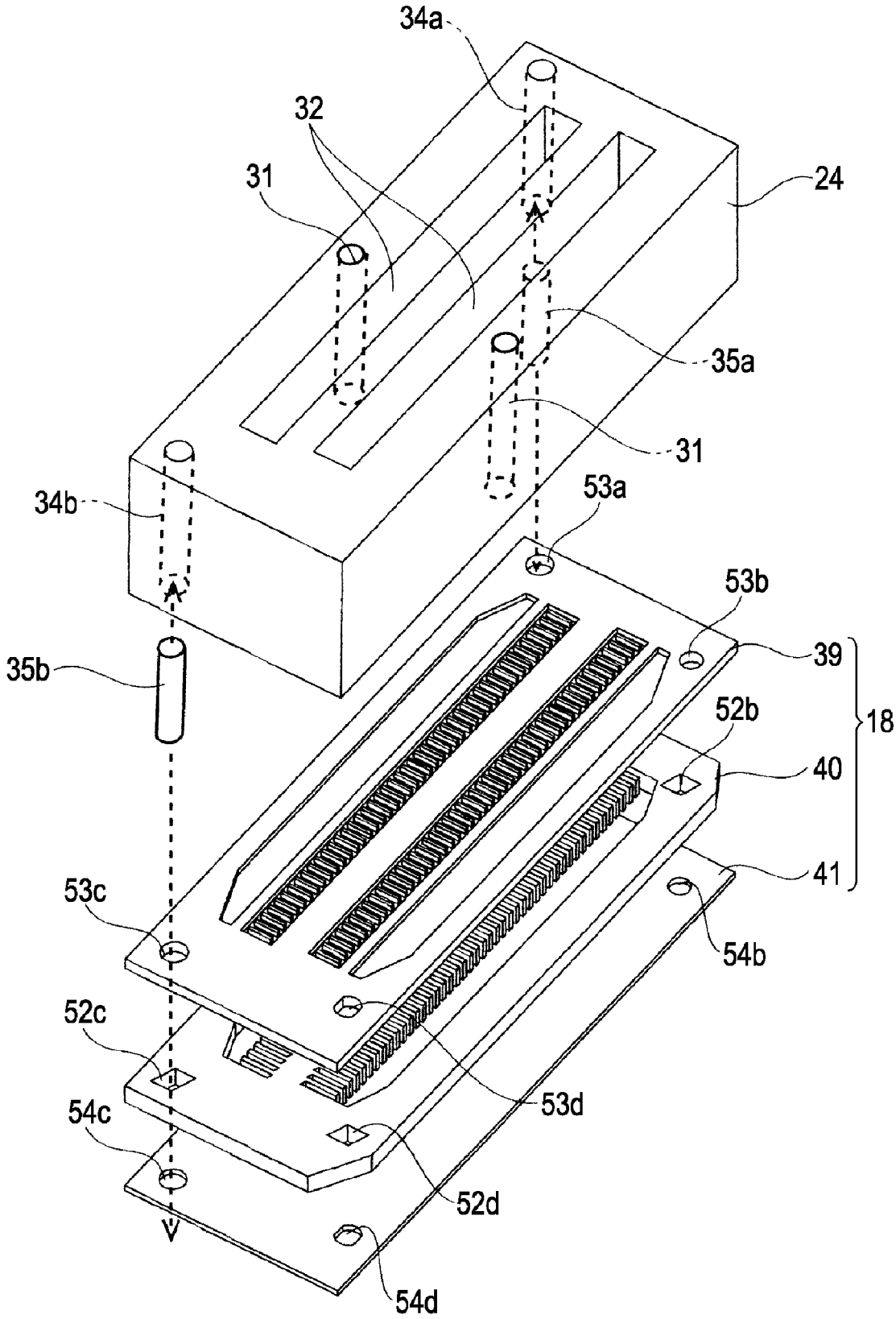
FIG. 3 is an exploded perspective view illustrating a channel unit and a head case.

FIG. 2 is a sectional view illustrating main part of the recording head 2, and FIG. 3 is an exploded perspective view illustrating a channel unit 18 and a head case 24. The recording head 2 in this embodiment has the overall structure including an actuator unit 16 consists of a plurality of piezoelectric vibrators 15, the channel unit 18 which forms a series of ink channels (a kind of a liquid channel) continuing from a common ink chamber 20 (common liquid chamber) to nozzle orifices 19 via ink feed openings 21 and pressure chambers 22, and the head case 24, etc.

The head case 24 is a casing in a hollow box form. Inside the head case 24 are provided a case channel 31 which is a channel leading the ink from the ink cartridge 3 to the common ink chamber 20, and accommodation chambers 32 for individually accommodating actuator units 16, respectively therein. This head case 24 is formed by a molding method using epoxy resin which is a kind of thermosetting resin, and the channel unit 18 is fixed to a channel mounting surface of the head case 24. Moreover, as shown in FIG. 3, the head case 24 is provided with pin holding portions 34*a* and 34*b* which are formed to penetrate the head case 24 in the height direction at a total of two places. A first pin holding portion 34*a* and a second pin holding portion 34*b* are empty sections for holding a first case pin 35*a* and a second case pin 35*b*, respectively. Each of the first and second pin holding portions 34*a* and 35*a* is a cylindrical shape having an inside diameter which is just slightly larger than the diameter of the case pin 35. In this embodiment, the first pin holding portion 34*a* and the second pin holding portion 34*b* are disposed at positions corresponding to a first reference hole 52*a* (see FIG. 4) and a third reference hole 52*c*, respectively provided in the channel substrate 40. The case pins 35*a* and 35 are installed to project from a channel mounting surface and to be inserted in the pin holding portions 34*a* and 34*b*, respectively by their tips. The diameter of each of the case pins 35*a* and 35 is equal to the diameter d1 of an inscribed circle Cv of each of the reference holes 52*a*, 52*b*, and 52*d*, which will be described later (see FIG. 6). In addition, positioning of the channel unit 18 and the head case 24 will be also described later.

The above-described actuator unit 16 consists of a piezoelectric vibrator 15 as a pressure generating means, a fixed board 37 to which this piezoelectric vibrator 15 is joined, and flexible cable 38 used for supplying a drive signal from a wiring board (not shown) to the piezoelectric vibrator 15. The piezoelectric vibrator 15 is mounted on the fixed plate on the fixed plate 37 made of metal board material, such as stainless steel in a cantilever form in which a free end of the piezoelectric vibrator 15 projects longer outward than the tip of the fixed plate 37. In addition, as the pressure generating means, an electrostatic actuator, a magnetostrictive element, an exothermic element, etc. can be used besides the above-described piezoelectric vibrator.

The channel unit 18 is produced by joining and integrating composition components including a vibrating plate 39, a channel substrate 40, and a nozzle substrate 41 in the state in which the composition components are laminated. Each of the pressure chambers 22 in the channel unit 18 is formed in the form of a slender chamber which extends in a direction which intersects perpendicularly to an arrangement direction of the nozzle orifice rows 19 (the nozzle orifice row arrangement direction). Moreover, the common ink chamber 20 is a chamber into which the ink is introduced from the ink introduction needle 13 side. The ink introduced into the common ink chamber 20 is distributed and supplied to all pressure chambers 22 through the ink feed openings 21.

The nozzle substrate 41 arranged at the bottom of the channel unit 18 is a thin metal board member provided with a plurality of nozzle orifices 19 arranged in the sub-scanning direction at a pitch corresponding to a dot pitch. In this embodiment, the nozzle substrate 41 is made of board material of stainless steel, in which a plurality of rows of nozzle orifices 19 (nozzle rows) is arranged in the scanning direction (the main scanning direction) of the recording head 1. Moreover, a single nozzle row consists of, for example, 180 nozzle orifices 19.

Figure 4:
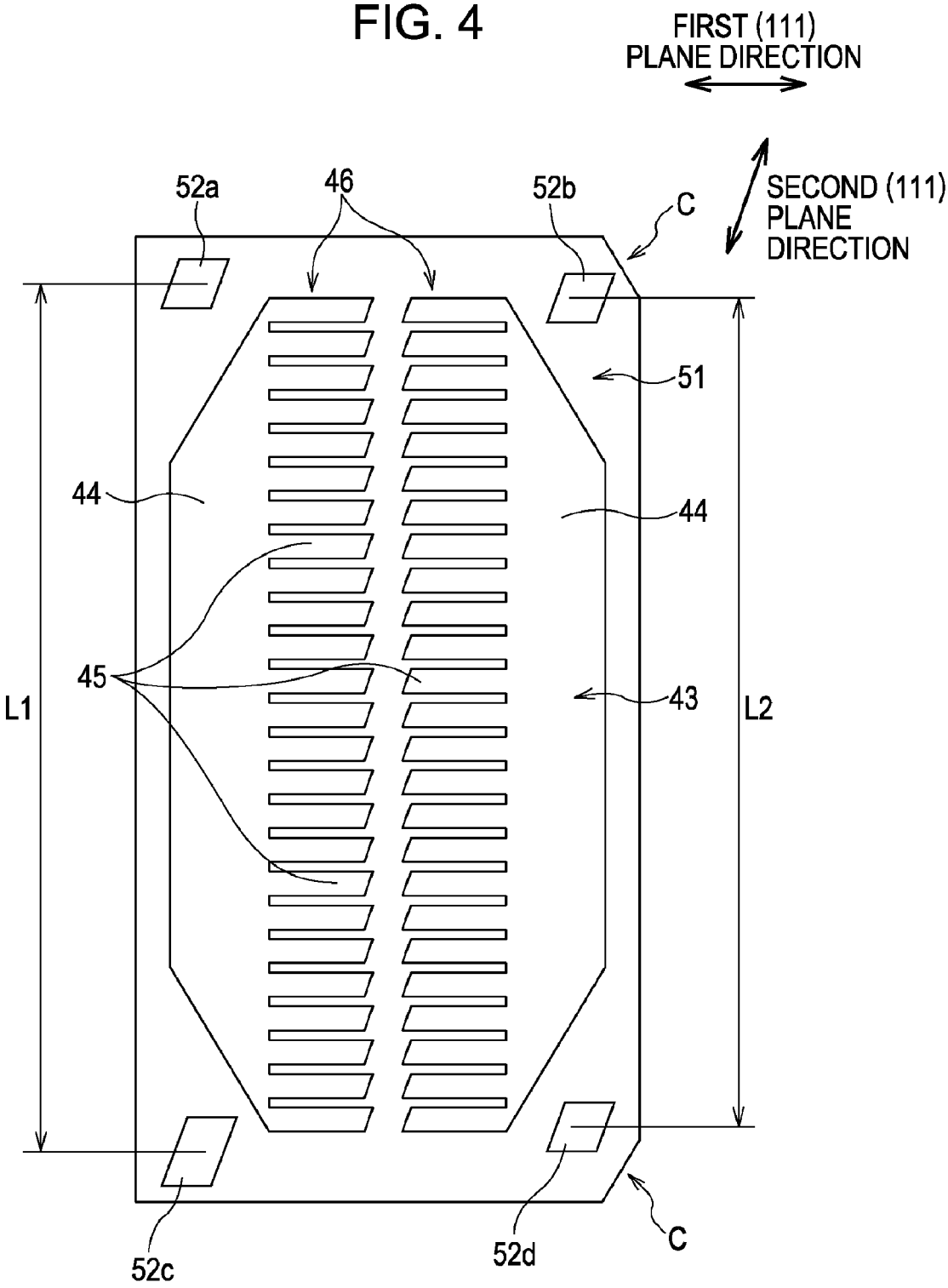
FIG. 4 is a plan view illustrating a structure of one exemplary channel substrate.
Figure 5:
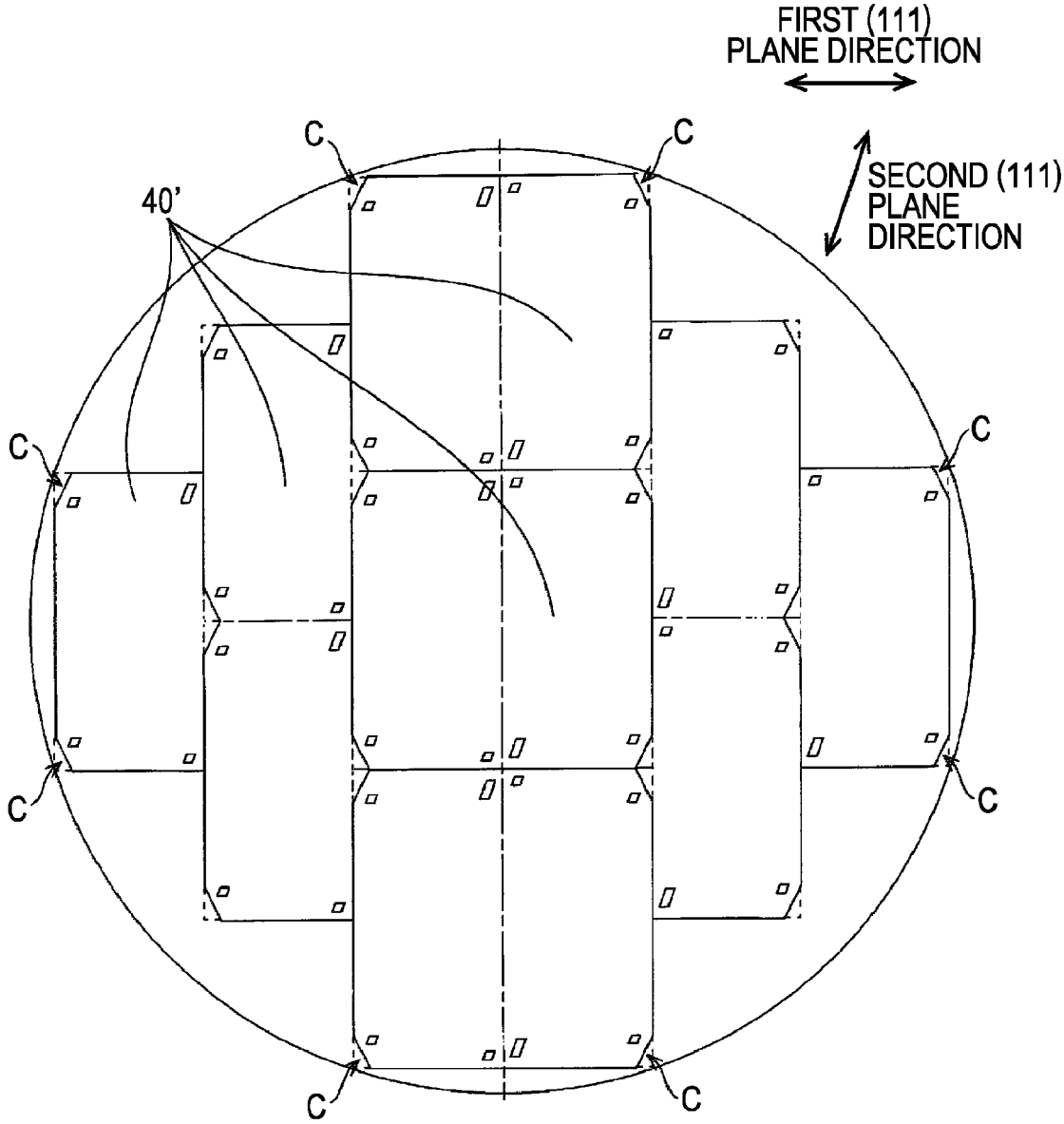
FIG. 5 is a plan view illustrating an exemplary layout of a substrate region in a silicon wafer.

FIG. 4 is a plan view illustrating a structure of the channel substrate 40, and FIG. 5 is a plan view illustrating a silicon wafer which is the base material of the channel substrate 40. The channel substrate 40 in this embodiment is a plate-shaped member in which channel sections 43 used as ink channels, an opening 44 specifically serving as the common ink chamber 20, grooves used as the ink feed openings 21, and pressure chamber cavities 45 used as the pressure chambers 22 are defined. This channel substrate 40 is produced by carrying out anisotropic etching of the silicon wafer which is a kind of a crystalline base material as shown in FIG. 5.

The above-described silicon wafer is a silicon single crystal substrate whose surface is set as the crystal orientation plane (110). On the surface of this silicon wafer, a plurality of substrate regions 40' (12 regions in this embodiment) used as the channel substrates 40 is demarcated by cutting planned lines, and each substrate region 40' is provided with the above-described channel sections 43 (not shown in FIG. 5) and reference holes which will be described later by carrying out anisotropic etching of each substrate region 40'. Moreover, in similar manner, a plurality of small through-holes is formed on the cutting planed lines so as to form a break pattern by carrying out anisotropic etching. A portion in which this break pattern is formed has become more nearly vulnerable than other portions, and thus if external force is applied to the silicon wafer, the portion with the break pattern will fracture and thus the silicon wafer has come to be divided into the channel substrates 40.

The channel substrate 40 is designed in the form of about a rectangle with both chamfered corners at end of one longer side (longer side on the left in FIG. 4) of two longer sides thereof. As shown in FIG. 5, the substrate regions 40' located at the outermost portions in the silicon water are arranged with the posture in which the chamfered portions C meet the circumference of the silicon wafer so as to have a layout in which as many channel substrates 40 as possible can be produced from one silicon wafer. Moreover, on a (110) plane (surface) of the channel substrate 40, the pressure chamber cavities 45 are arranged in rows each row extending in a vertical axis direction of a first (111) plane (corresponding to the first crystal orientation plane in the invention) which perpendicularly intersects a (110) plane so as to form the pressure chamber cavity rows 46. The pressure chamber cavities 45 correspond to nozzle orifices 19 of the nozzle substrate 41, respectively. Moreover, a plurality of pressure chamber cavity rows 46 (2 rows in an example of FIG. 4) are arranged in parallel to each other in a direction of the first (111) plane so as to correspond to the nozzle rows, respectively.

The above-described vibrating board 39 is a compound board of a dual structure formed by laminating an elastic film 39*b*, such as PPS resin, on a support plate 39*a* of metal, such as stainless steel, as shown in FIG. 2. In this vibrating board 39, island sections 48 for joining the tips of the free ends of the piezoelectric vibrators 15 are formed in the portions corresponding to the pressure chambers 22, and these portions function as diaphragms. That is, this vibrating board 39 is structured such that the elastic film around the island sections 48 may cause elastic deformation in response to the operation of the piezoelectric vibrators 15. Moreover, the vibrating board 39 seals the opening of the common ink chamber 20 of the channel substrate 40, and thus also functions as a compliance section 49. The support plate 39*a* is removed at about the portions equivalent to the compliance sections 49, and thus only the elastic film 39*b* exist at the portions equivalent to the compliance sections 49. In addition, the vibrating plate 39 can also be called a sealing plate which seals the opening side of the channel sections 43 formed in the channel substrate 40.

In the above-described channel substrate 40, in a region 51 disposed outside the channel forming region for forming the channel section 43 therein, as shown in FIG. 4, reference holes 52 for specifying the relative position with the vibrating board 39 and the nozzle substrate 42, or the head case 24 are established a total of four places. In greater detail, a first reference hole 52*a* specifically arranged at the upper left of the frame region 51 in FIG. 4, a second reference hole 52*b* arranged at the upper right of the frame region 51, a third reference hole 52*c* arranged at the lower left of the frame region 51, and a fourth reference hole 52*d* arranged at the lower right of the frame region 51 are established. That is, the first reference hole 52*a* and the second reference hole 52*b* are established at one side of the region 51 of the pressure chamber cavity row direction, and the third reference and the fourth reference hole 52*c* and 52*d* are established at the other side of the region 51 of the pressure chamber cavity row direction.

The upper right corner and the lower right corner of the channel substrate are chamfered and thus the second reference hole 52*b* and the fourth reference hole 52*d* are formed a little inner side in the arrangement direction of the pressure chamber cavity rows to avoid the chamfered portions C. Therefore, the distance L1 between holes, i.e. the distance between the center of the first reference hole 52*a* and the center of the third reference hole 52*c* is longer than the distance L2 between holes i.e. the distance between the center of the second reference hole 52*b* and the center of the fourth reference hole 52*d*. As for the distance L1 and L2 between these holes, it is preferable to be set up more than the full length of the pressure chamber cavity row 46. This is because positioning accuracy more improves as the distance between holes used as the reference in positioning becomes longer.

Figure 6A:
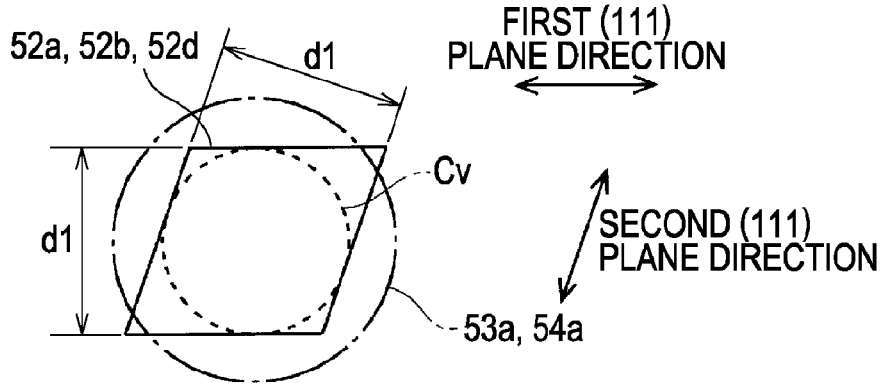
FIG. 6A is an explanatory view illustrating a first reference hole, a second reference hole, and a fourth reference hole
Figure 6B:
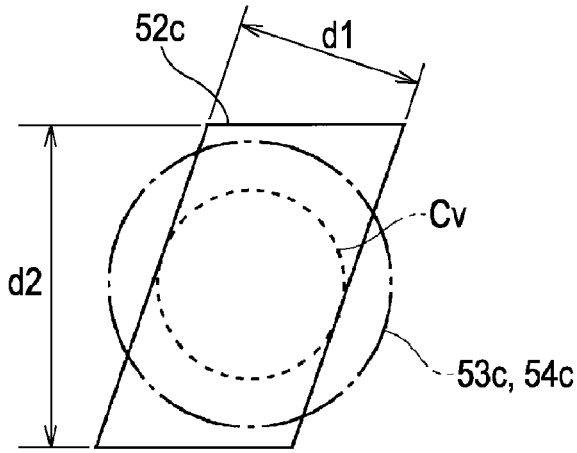
FIG. 6B is an explanatory view illustrating a third reference hole.

As shown in FIG. 6(*a*), the first reference hole 52*a*, the second reference hole 52*b*, and the fourth reference hole 52*d* are formed in a polygonal shape whose longer sides are provided to the first (111) plane and the second (111) plane (corresponding to the second crystal orientation plane in the invention), respectively, in which the second (111) plane obliquely intersects the first (111) plane 70 at an angle of 53° and also perpendicularly intersects the surface of the silicon wafer (the surface of the channel substrate 40). In this embodiment, the polygonal shape is a lozenge shape having four sides the lengths of which are equal to each other. As for dimension of the reference holes 52*a*, 52*b*, and 52*d*, the perpendicular distance of opposing sides is set to be d1. In other words, the dimension of the reference holes is set to be the diameter d1 of an imaginary inscribed circle Cv inscribed in each of the reference holes 52*a*, 52*b*, and 52*d*. The diameter d1 of the inscribed circle Cv is also equal to the diameter of positioning pins 57 of a jig 56 which will be described later and to the diameter of the above-described case pin 35.

As shown in FIG. 6(*b*), the third reference hole 52*c* differs from the other reference holes 52*a*, 52*b*, and 52*d* in the shape. For example, the third reference hole 52*c* is a long hole in the form of a parallelogram whose shorter sides are formed by the first (111) plane and whose longer sides are formed by the second (111) plane. The dimension of the shorter sides of the third reference hole 52*c* is equal to the dimension of each side of the reference holes 52*a*, 52*b*, and 52*d*. In detail, the distance between the opposing longer sides in the direction perpendicular to the longer sides is set to be d1. On the other hand, the distance between the opposing shorter sides in the direction perpendicular to the shorter sides is set to be d2 which is longer than d1. In this manner, of the four reference holes 52 of the channel substrate 40, only the third reference hole 52*c* is a long hole extending in a direction of the second (111) surface. The first reference hole 52*a* and the third reference hole 52*c* are reference holes used for positioning the channel unit 18 and the head case 24. The second reference hole 52*b* and the fourth reference hole 52*d* are reference holes used for positioning the composition components of the channel unit 18.

As shown in FIG. 3, the vibrating plate 39 and the nozzle substrate 41 are provided with the through-holes 53 and 54, respectively established at the positions corresponding to the reference holes 52 of the channel substrate 40. That is, the vibrating plate 39 is provided with a first through-hole 53*a*, a second through-hole 53*b*, a third through-hole 53*c*, and a fourth through-hole 53*d* at the positions corresponding to the first reference hole 52*a*, the second reference hole 52*b*, the third reference hole 52*c*, and the fourth reference hole 52*d* of the channel substrate 40, respectively. In the similar manner, the nozzle substrate 41 is provided with the first through-hole 54*a*, the second through-hole 54*b*, the third through-hole 54*c*, and the fourth through-hole 54*d* at the positions corresponding to the first reference hole 52*a*, the second reference hole 52*b*, the third reference hole 52*c*, and the fourth reference hole 52*d*, respectively.

The second through-holes 53*b* and 54*b* of the through-holes 53 and 54 have the perfect circle shape whose diameter is set as d1. Moreover, the fourth through-holes 53*d* and 54*d* have a long hole shape corresponding to an expanded form of the perfect circle having the diameter d1, which is expanded in the direction of a row of the second through-hole and the fourth through-hole. That is, the inside dimension of the fourth through-holes 53*d* and 54*d* in the direction of a row of the second through-holes 53*b* and 54*b* and the fourth through-holes 53*d* and 54*d* is set up to be longer than the diameter d1 of the inscribed circle Cv. Alternatively, the fourth through-holes 53*d* and 54*d* may have the perfect circle shape, and the second through-holes 53*b* and 54*b* may have the long hole shape. Furthermore, the first through-holes 53*a* and 54*a* and the third through-holes 53*c* and 54*c* are set to have the larger diameter than the diameter d1 of the inscribed circle Cv, as shown in FIG. 6.

Figure 7:
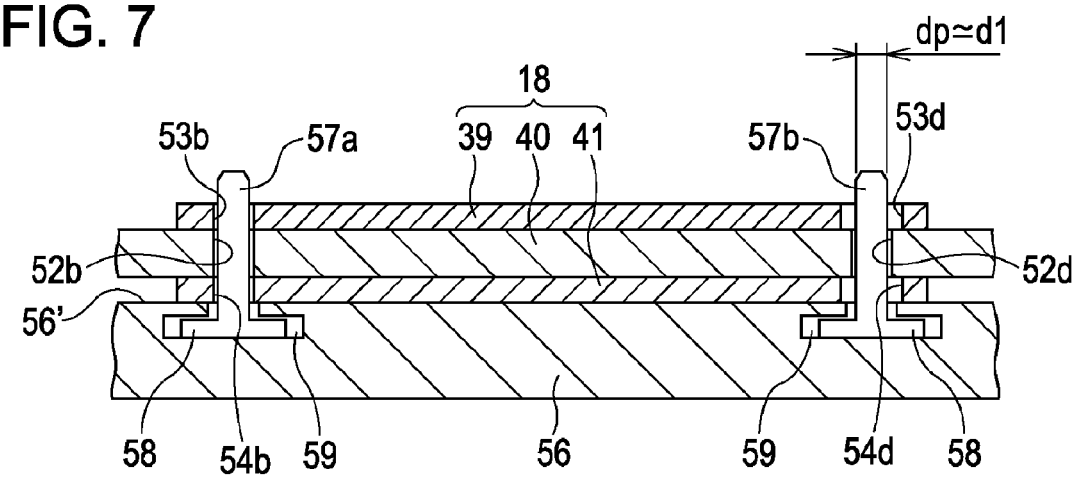
FIG. 7 is a sectional view illustrating a state of laminating composition components of the channel unit using a jig.

When joining these composition components of the channel unit, as shown in FIG. 7, the composition components are laminated one by one on a jig 56. The first positioning pin 57*a* is formed to project from the channel unit installation surface 56' of the jig 56 at the position corresponding to the second reference hole 52*b* and the second through-holes 53*b* and 54*b*, and the second positioning pin 57*b* is formed to project from the channel unit installation surface of the jig 56 at the position corresponding to the fourth reference hole 52*d*, and the fourth through-holes 53*d* and 54*d*. The positioning pins 57 are made of, for example metal, such as stainless steel, and the diameter dp of the positioning pins 57 is equal to the diameter d1 of the inscribed circle Cv of the reference holes 52*a* and 52*b* (correctly, set to be slightly smaller than d1 to facilitate insertion of the positioning pins into the reference holes and to prevent the positioning pins from jarring against the holes). Moreover, a flange 58 is provided to the rear anchor portion of each of the positioning pins 57 so as to protrude from the side surface of the rear anchor portion of the corresponding positioning pin 57 (in a direction of the diameter of the positioning pin). The jig 56 is provided with holding cavities 59, and the flanges 58 are held in the holding cavities 59 in the state in which main body portions of the positioning pins 57 are installed so as to perpendicularly protrude from the channel unit installation surface 56'. The dimension of the holding cavities 59 in the depth direction is equal to the thickness of the flange 58. However, the dimension of each of the holding cavities 59 in the width direction thereof is set so as to provide a small gap between the inside surface of the holding cavity 59 and the side surface of the flange 58 provided to the rear anchor portion of the positioning pin 57. With such a structure, the positioning pins 57 can slide in the lateral direction while maintaining the posture in which the positioning pins 57 are perpendicular to the channel unit installation surface 56'.

In this embodiment, first, the nozzle substrate 41 is laminated on channel unit installation surface 56' of the jig 56 in the state in which the first positioning pin 57*a* is inserted in the second through-hole 54*b*, and the second positioning pin 57*b* is inserted in the fourth through-hole 54*d*. Next, the channel substrate 40 is placed on the nozzle substrate 41 in the state in which the second positioning pin 57*b* is inserted in the second reference hole 52*b* and the first positioning pin 57*a* is inserted in the fourth reference hole 52*d* with an adhesive interposed between the channel substrate 40 and the nozzle substrate 41. Next, the vibrating plate 39 is placed on the channel substrate 40 in the state in which the first positioning pin 57*a* is inserted in the second through-holes 53*b* and the second positioning pin 57*b* is inserted in the fourth through-hole 53*d* with an adhesive interposed between the vibrating plate 39 and the channel substrate 40.

Thus, in the state in which the relative positions of the nozzle substrate 41, the channel substrate 40, and the vibrating plate 39 are joined and assembled in the state in which the relative positions of them are specified, and thus the channel unit 18 is produced. Under such circumstances, since the positioning pins 57 slide in compliance with the interval of the second reference hole 52*b* and the fourth reference hole 52*d*, it is possible to perform positioning of the composition components of the channel substrate 40 without applying mechanical stress to the channel substrate 40. Moreover, in this embodiment, since the fourth through-hole 53*d* of the vibrating plate 39 and the fourth through-hole 54*d* of the nozzle substrate 41 have the long hole shape, in the case in which there is a difference among the hole-to-hole distance between the second reference hole 52*b* and the fourth reference hole 52*d* in the channel substrate 40, the hole-to-hole distance between the second through-hole 53*b* and the fourth through-holes 53*d* in vibrating plate 39, and the hole-to-hole distance between the second through-hole 54*b* and 54*d* of the fourth through-holes in the nozzle substrate 41, the interval of the positioning pins 57 are adjusted so as to match with the interval of the second reference hole 52*b* and the fourth reference hole 52*d*, the above-described differences can be offset by the gap between the inside surface of the long hole and the positioning pin 57*b*. Accordingly, the relative position of the channel unit composition components is defined on the basis of the second reference hole 52*b* and the fourth reference hole 52*d* of the channel substrate 40.

Thus, since the relative position of each composition component of the channel unit 18 is specified on the basis of the second reference hole 52*b* and the fourth reference hole 52*d* in a manner such that the second reference hole 52*b* is aligned to overlap the second through-holes 53*b* and 54*b*, the fourth reference hole 52*d* is aligned to overlap the fourth through-holes 53*d* and 54*d*, and then the positioning pins 57 are inserted in the reference holes and the through-holes, it is possible to perform positioning with high accuracy without applying the mechanical stress to the channel substrate 40.

After each composition component of the channel unit is laminated on jig 56 and the adhesives between the components are cured, the positioning pins 57 are removed from the holes 52*b*, 52*d*, 53*b*, 53*d*, 54*b*, and 54*d* of the channel unit composition component (that is, the channel unit 18 is separated from the jig 56), and the channel unit 18 is joined to the channel mounting surface of the head case 24 with the posture in which the vibrating plate side of the channel unit 18 faces the head case 24. Under such circumstances, the relative positions of the channel unit 18 and the head case 24 are specified by inserting the first case pin 35*a* in the first reference hole 52*a* and the first through-holes 53*a* and 54*a*, and inserting the second case pin 35*b* in the third reference hole 52*c* and the third through-holes 53*c* and 54*c*, and then the channel unit 18 is fixed to the channel mounting surface (not shown) of the head case 24.

As described above, the third reference hole 52*c* has the long hole shape, the diameters of the third reference holes 53*c* and 54*c* are set to be larger than the diameters of the case pins 35 (the diameters of the inscribed circles Cv), respectively, and a gap is provided between each of the third reference hole 52*c* and the third through-holes 53*c* and 54*c* and the second case pin 35*b*. Accordingly, in positioning of the head case 24 and the channel unit 18, it is possible to eliminate a difference between the hole-to-hole distance between the first reference hole 52*a* and the third reference hole 52*c* and the pin-to-pin distance between the positioning pins 57*a* and 35*b* (the distance between the pin holing portions 34*a* and 34*b* of the head case 24) by the gap. Thus, it is possible to join the channel unit 18 to the head case 24 in the state in which the positions of the channel unit 18 and the head case 24 are aligned with sufficient accuracy.

Since the third reference hole 52*c* that has the long hole shape elongates in a direction aslant to a row of the third reference hole 52*c* and the first reference hole (the direction of the second (111) surface) with this embodiment here, when the center of the third reference hole 52*c* and the main axis of the second case pin 35*b* are mismatched with each other, the channel unit 18 may be displaced with respect to the head case 24 in a rotation direction with the first case pin 35*a* as a rotation center. However, since the positioning accuracy required for between the channel unit 18 and the head case 24 is not so high as the positioning accuracy required for between the channel unit composition components, the positional mismatch is permitted. Moreover, in consideration of the form of the channel substrate 40 illustrated to FIG. 4, since each reference hole is arranged such that the hole-to-hole distance L1 between the first reference hole 52*a* and the third reference hole 52*c* is longer than the hole-to-hole distance L2 between the centers of the second reference hole 52*b* and the fourth reference hole 52*d*, it is possible to suppress negative effect of the positional mismatch to the minimum.

In addition, each reference hole 52 is arranged in four corners of the channel substrate 40 in this embodiment in consideration of the space relationship in the frame region 51 and the sealing property upon sealing the nozzle formed surface by the capping mechanism. However, in the case in which the frame region is sufficiently large, and the sealing property can be secured at the time of capping, it is possible to prevent the positional mismatch from occurring in the rotation direction in which the first case pin 35*a* of the channel unit 18 is a rotation center by arranging the first reference hole 52*a* and the third reference hole 52*c* in the direction of the second (111) surface.

As described above, in the above-described recording head 2, positioning of the nozzle substrate 39, the channel substrate 40, and sealing plate 41 is carried out on the basis of second reference hole 52*b* and the fourth reference holes 52*d* of the channel substrate 40. Further, the positioning alignment between the channel unit 18 and the head case 24 is carried out in a manner such that the first case pin 35*a* is inserted in the first reference hole 52*a* and the first through-holes 53*a* and 54*a*, and the second case pin 35*b* is inserted in the third reference hole 52*c* and the third through-holes 53*c* and 54*c*. Accordingly, it is possible to assemble the composition components with sufficient positioning accuracy without applying mechanical stress to the channel substrate 40.

Moreover, since the hole for positioning between channel unit composition components and the hole for positioning between the channel substrate and the head case 24 are separately provided, the diameter of the first through-holes 53*a* and 54*a* and the third through-holes 53*c* and 54*c* can be set up more greatly than the diameter of the above-described inscribed circle Cv. Accordingly, the projection portion of the vibrating plate 39 or the nozzle substrate 41 in the openings of the reference holes 52*a* and 52*c* can be made small. Thus, it is possible to facilitate insertion of the case pins 35. Moreover, when inserting the case pins 35, it is possible to prevent the case pins 35 from coming into contact with the projection portions in the holes and thus to prevent the projection portions from missing.

In the recording head 2 assembled in the above-described manner, the case pins 35 are inserted in the openings of the first reference hole 52*a* (the first through-holes 53*a* and 54*a*) and the third reference hole 52*c* (the third through-holes 53*c* and 54*c*), but the inside of the openings of the second reference hole 52*b* (the second through-holes 53*b* and 54*b*) and the fourth reference hole 52*d* (the fourth through-holes 53*d* and 54*d*) remain empty. Accordingly, the ink is likely to enter these empty holes. For this reason, if the second reference hole 52*b* and the fourth reference hole 52*d* are arranged at the upper stream side of the direction of wiping performed by the wiping mechanism 12 when attaching the recording head 2 to the printer 1, the wiper blade 12' draws out the ink accommodated in the empty holes to the nozzle formed surface upon the wiping and thus there is the likelihood that the nozzle formed surface may be contaminated. In consideration of this point, the recording head 2 is mounted in the printer 1 with the posture in which the second reference hole 52*b* and the fourth reference hole 52*d* are arranged at the lower stream side of the direction of wiping when the wiping mechanism 12 wipes the nozzle formed surface. Thanks to such a structure, it is possible to prevent the wiping blade 12' from leading the ink accommodated in the openings to the nozzle formed surface and thus to prevent the nozzle formed surface from being contaminated.

Moreover, since the above-described printer 1 carries the recording head 2 attached thereto in the state in which the composition components are positioned with sufficient accuracy, it is possible to discharge ink droplets of a predetermined amount from the nozzle orifices 19 at predetermined speed at the time of performing discharge operation (record operation) by this recording head 2, and thus the discharged ink droplets can strike the recording paper 6 with high precision. Accordingly, it is possible to improve the quality of a recorded picture.

This invention must not be limited to the above-described embodiment, and various modification can be achieved on the basis of the statement of claims.

For example, although the above-described embodiment showed the example in which each reference hole of the channel substrate 40 is constituted in the shape of a parallelogram (lozenge) defined by the first (111) surface and the second (111) surface, the invention is not limited thereto. For example, it is possible to constitute each reference hole in the form of a hexagon using etching residue.

Moreover, although the above-described embodiment showed the example which used the second reference hole 52*b* and the fourth reference hole 52*d* as the hole for positioning between the channel unit composition components, and used the first reference hole 52*a* and the third reference hole 52*c* as the hole for positioning between the channel unit 18 and the head case 24, the invention is not limited thereto. For example, the first reference hole 52*a* and the fourth reference hole 52*d* may be used as the hole for positioning between channel unit composition components, and the second reference hole 52*b* and the third reference hole 52*c* may be used as the hole for positioning between the channel unit 18 and the head case 24. According to such a structure, since the distance between holes used at the time of positioning can be secured longer, it is possible to improve the positioning accuracy. In short words, it is preferable that at least the third reference hole 52*c* that is a long hole is used as one of the holes for positioning between the channel unit 18 and the head case 24.

Moreover, this invention is applicable not only to the above-described printer but other liquid ejection heads and liquid fuel ejection apparatuses. For example, this invention is applied to a display manufacturing apparatus used for forming a color filter of a liquid crystal device, an electrode manufacturing apparatus used for forming electrodes of an organic electroluminescence (Electro Luminescence) display and an FED (field luminescence display), and a chip manufacturing apparatus used for forming biochips (biotips), etc.

The entire disclosure of Japanese Patent Application No. 2007-014075, filed Jan. 24, 2007 is expressly incorporated by reference herein.

What is claimed is:

1. A liquid ejection head comprising:

a channel unit including a channel substrate provided with a channel section which includes pressure chamber cavity rows formed by arranging a plurality of pressure chamber cavities to be pressure chambers in rows, a nozzle substrate provided with a plurality of nozzle orifices formed so as to correspond to the pressure chambers, respectively, and a sealing plate which seals an opening of the channel section of the channel substrate, wherein the nozzle substrate is joined with one surface of the channel substrate and the sealing plate is joined with the opposite surface of the channel substrate so that the channel unit has a series of liquid channels from a common liquid chamber to the nozzle orifices via the process chambers;

wherein a first reference hole and a second reference hole are disposed in a frame region formed outside a channel section forming region at one side of an arrangement direction of the pressure chamber cavity rows, and a third reference hole and a fourth reference hole are formed in the frame region at the opposite side of the arrangement direction of the pressure chamber cavity rows, wherein the first reference hole, the second reference hole, and the fourth reference hole have a polygonal shape whose sides are equal to each other in length, wherein the third reference hole has a polygonal shape whose sides are different in length, in which dimension of shorter sides of the third reference hole is equal to dimension of the sides of the other reference holes other than the third reference hole, and wherein each of the nozzle substrate and the sealing plate is provided with a first through-hole, a second through-hole, a third through-hole, and a fourth through-hole at positions corresponding to the first reference hole, the second reference hole, the third reference hole, and the fourth reference hole of the channel substrate.

2. The liquid ejection head according to claim 1, wherein the channel substrate is made of a crystalline base material.

3. The liquid ejection head according to claim 1, wherein the pressure chamber cavity rows of the channel substrate are formed by arranging the pressure chamber cavities in rows in a vertical axis direction of a first crystal orientation plane which perpendicularly intersects a surface of a crystalline base material.

4. The liquid ejection head according to claim 1, wherein the first reference hole, the second reference hole, and the fourth reference hole have a lozenge shape having four sides which are equal to each other in length, in which the sides of the lozenge shape are on the first crystal orientation plane perpendicularly intersecting a surface of a crystalline base material and a second crystal orientation plane obliquely intersecting the first crystal orientation plane and perpendicularly intersecting the surface of the crystalline base material.

5. The liquid ejection head according to claim 1, wherein the third reference hole is a long hole in the form of a parallelogram whose shorter sides are on a first crystal orientation plane perpendicularly intersecting a surface of a crystalline base material and whose longer sides are on a second crystal orientation plane obliquely intersecting the first crystal orientation plane and perpendicularly intersecting the surface of the crystalline base material.

6. The liquid ejection head according to claim 1, wherein either the second through-holes or the fourth through-holes of the nozzle substrate and the sealing plate have a perfect circle shape with a diameter which is equal to a diameter of an inscribed circle of the reference holes other than the third reference-hole, wherein the others of the second through-holes and the fourth through-holes have a long hole shape corresponding to an expanded form of the former through-holes expanded in a direction of a row of both the second through-holes and the fourth through-holes, and wherein inside dimension of the first through-hole and the third through-hole is set to be larger than a diameter of the inscribed circle.

7. The liquid ejection head according to claim 1, wherein a distance between centers of the first reference hole and the third reference hole is longer than a distance between centers of the second reference hole and the fourth reference hole.

8. A liquid ejection apparatus comprising the liquid ejection head according to claim 1.

9. The liquid ejection apparatus according to claim 8, further comprising a wiping mechanism which wipes a nozzle formed surface of the liquid ejection head, wherein the liquid ejection head is mounted in a manner such that the second reference hole and the fourth reference hole are disposed at the lower stream side of a direction of wiping performed with respect to the nozzle formed surface by the wiping mechanism.

10. A manufacturing method of the liquid ejection head according to claim 1, further comprising a head case to which the channel unit is fixed:

forming a first case pin and a second case pin so as to project from a channel mounting surface of the head case at positions corresponding to the first reference hole and the third reference hole of the channel substrate, respectively;

specifying relative positions of the nozzle substrate, the channel substrate, and the sealing plate on the basis of the second reference hole and the fourth reference hole by positioning the second reference hole and the fourth reference hole so as to overlap the second through-hole and the fourth through-hole, respectively and inserting positioning pins in the second reference hole and the fourth reference hole, respectively; and fixing the channel unit to the channel mounting surface of the head case in the state in which the relative positions of the channel unit and the head case are specified by way of operations of jointing the nozzle substrate, the channel substrate, and the sealing plate with each other after specifying the relative positions of the nozzle substrate, the channel substrate, and the sealing plate, removing the positioning pins from the corresponding holes, and inserting the first case pin in the first reference hole and the first through-hole and the second case pin in the third reference hole and the third through-hole.

* * * * *